United States Patent [19]

Goossens et al.

[11] Patent Number: 4,641,333

[45] Date of Patent: Feb. 3, 1987

[54] METHOD OF MANUFACTURING AN X-RAY TUBE ROTARY ANODE AND AN X-RAY TUBE ROTARY ANODE MANUFACTURED ACCORDING TO THIS METHOD

[75] Inventors: Laurentius M. J. Goossens; Gerhardus A. te Raa; Bernhard J. P. van Rheenen, all of Eindhoven, Netherlands

[73] Assignee: U.S. Philips Corporation, New York, N.Y.

[21] Appl. No.: 773,725

[22] Filed: Sep. 9, 1985

[30] Foreign Application Priority Data

Sep. 14, 1984 [NL] Netherlands ..... 8402828

[51] Int. Cl.[4] ..... H01J 35/10

[52] U.S. Cl. ..... 378/144; 445/28; 445/35; 219/76.16

[58] Field of Search ..... 445/28, 35; 427/34; 378/144; 219/78.16

[56] References Cited

U.S. PATENT DOCUMENTS

| | | | |
|---|---|---|---|
| 3,735,458 | 5/1973 | Magedans et al. | 445/28 |
| 3,993,923 | 11/1976 | Magendans et al. | 378/144 |
| 4,090,103 | 5/1978 | Machenschalk | 378/144 |
| 4,224,273 | 9/1980 | Magendans et al. | 445/35 X |
| 4,320,323 | 3/1982 | Magendans et al. | 427/123 |
| 4,534,993 | 8/1985 | Magendans et al. | 427/34 |

FOREIGN PATENT DOCUMENTS

| | | |
|---|---|---|
| 704737 | 2/1954 | United Kingdom . |
| 1308679 | 2/1973 | United Kingdom . |
| 1505587 | 3/1978 | United Kingdom . |

*Primary Examiner*—Kenneth J. Ramsey
*Attorney, Agent, or Firm*—Robert J. Kraus

[57] ABSTRACT

The method provides an X-ray tube rotary anode by increasing the thickness of a thin, highly deformed anode disc to the desired value by deposition of a layer, consisting mainly of molybdenum, by means of thermal spraying. The method provides an X-ray rotary anode which has the attractive properties of a highly deformed anode disc and which also has a large diameter which cannot be obtained by means of the high-speed deformation impact process due to the maximum applicable thickness-diameter ratio.

8 Claims, 4 Drawing Figures

METHOD OF MANUFACTURING AN X-RAY TUBE ROTARY ANODE AND AN X-RAY TUBE ROTARY ANODE MANUFACTURED ACCORDING TO THIS METHOD

BACKGROUND OF THE INVENTION

The invention relates to a method of manufacturing an X-ray tube laminated rotary anode, having a target area for the electrons which consists of tungsten or a tungsten alloy and a support which consists of molybdenum or a molybdenum alloy, in which a disc-shaped portion consisting of tungsten or a tungsten alloy and a disc-shaped portion consisting of molybdenum or a molybdenum alloy are joined by means of a high-speed deformation impact process, so that the diameters of the disc-shaped portions increase and their thicknesses decrease, after which the desired anode shape is imparted to the body thus formed.

The invention also relates to the X-ray tube laminated rotary anode obtained by means of this method.

The invention has for its object to provide X-ray rotary anodes for use in X-ray tubes which are exposed to high loads, such as X-ray tubes for medical applications.

British Patent Specification GB No. 1308679 (corresponding to U.S. Pat. No. 3,735,458) discloses such a method and such an X-ray tube rotary anode. In the specification, the body thus obtained is stress-relieved by annealing, after which it is machined to obtain the desired anode shape.

A high-speed deformation impact process is to be understood to mean herein a deformation process, in which a device comprising flat press blocks is used to deform a work piece by subjecting it to a small number of blows or preferably a single blow of high energy content. Devices for carrying out such a method are known per se. Very good results can be obtained by using a machine whose press blocks are moved towards each other at high speed by means of gas pressure (the so-called pneumatic-hydraulic machines).

It will be apparent that the increase of the diameters of both disc-shaped portions resulting from the high-speed deformation impact process must be substantially the same. For this purpose, according to the above-mentioned British Patent Specification GB No. 1308679, the thickness, temperature, nature and quality of the materials used for the disc-shaped portions are chosen so that the deformabilities of the disc-shaped portions are adapted to each other. When use is made of the method described above, the deformation resulting from the high-speed deformation impact process must amount to at least 60% and preferably to 75%. The degree of deformation is measured by comparing the decrease in thickness with the thickness before the high-speed deformation impact process.

The highly deformed X-ray tube rotary anodes manufactured in accordance with the method described above have a very stable shape. The target area only roughens for the electrons slightly during operation of the rotary anode in the X-ray tube. Owing to the high density of the target area (higher than 99%), only a very small amount of gas is set free in the X-ray tube at the high temperature occurring in the loaded condition. The density is expressed as a percentage of the theoretical density.

A disadvantage of the method described above is that, due to the maximum applicable thickness-diameter ratio of the disc-shaped portions used in the high-speed deformation impact process, only relatively thin anode discs can be manufactured. Owing to progress in the domain of medical X-ray equipment, the X-ray tube should be capable of withstanding severe loads for a prolonged period of time; therefore there is a need for larger and thicker anode discs than the ones commonly used in existing X-ray tube rotary anodes. The thermal capacity increases as a result of the larger dimensions. The use of a highly deformed anode disc is required to ensure that the mechanical strength suffices for applications involving a high temperature and a high rate of rotation.

SUMMARY OF THE INVENTION

The invention has for its object to provide an X-ray tube rotary anode having the desired favorable properties of the highly deformed X-ray tube rotary anodes and with a large thickness and a large diameter, for example a thickness of more than 12 mm.

This object is achieved in accordance with the invention by using a method as described in the preamble in which, upon completion of the high-speed deformation impact process, a further layer which comprises molybdenum or a molybdenum alloy having a density of at least 85% of the theoretical density is applied by means of a thermal spraying process to the disc-shaped portion which consists mainly of molybdenum. In order to obtain an adequate bonding and a low emission of gas, the density is preferably higher than 93% of the theoretical density.

Thermal spraying is to be understood to include known techniques, such as plasma spraying, arc spraying, flame-powder spraying and flame-wire spraying.

From Dutch Patent Specification NL 85 468 (corresponding to British Pat. No. 704,737) a method is known in which a layer of molybdenum is provided on a target disc by sintering a suitable amount of molybdenum powder; however, the high temperature required (2100° C.) renders this method unsuitable for applying a layer onto a highly deformed anode disc. A highly deformed anode disc of, for example, the molybdenum alloy sold under the trade name TZM loses its specific favorable properties when it is heated to a temperature in excess of 1650° C. In the case of an anode disc of pure molybdenum, the maximum permissible temperature is 1100° C. The porosity of a layer of molybdenum sintered at 1650° C. is too high (density less than 70%) which, upon incorporation in an X-ray tube, brings about a considerable emission of gas.

A method is known from Dutch Patent Application NL No. 7406496 (corresponding to British Pat. No. 1,505,587) in which a cooling disc of silver or copper is applied onto a target disc of tungsten or molybdenum by means of the plasma-MIG arc-welding process. However, as in the case of plasma-MIG arc-welding of molybdenum, the required temperature is undesirably high.

Using a method according to the invention, it is effective to heat the body formed by the high-speed deformation impact process to a temperature of over 800° C. before applying the layer of molybdenum by means of thermal spraying. Thus, a high density and a proper bonding of the layer of molybdenum are obtained. Preferably, the thermal spraying process is carried out at a temperature of from 800° to 1600° C.

In order to prevent oxide forming, it is efficient to carry out the thermal spraying process in an atmosphere containing less than 1% by volume of $O_2$.

In order to obtain an X-ray tube rotary anode having a high thermal capacity, the thickness of the layer which is deposited by means of thermal spraying should preferably not be less than 6 mm.

All known thermal spraying techniques can be used in the method according to the invention, provided that the anode disc is not heated to a temperature in excess of 1650° C. In a preferred version of the method according to the invention, the thermal spraying process is carried out by means of plasma spraying.

In order to degass the anode disc it is efficient that upon completion of the thermal spraying process, the laminated anode is annealed in a reducing atmosphere at a temperature of from 1100° to 1600° C. for at least one hour. In the course of this process the density of the deposited layer of molybdenum increases due to sintering and partial recrystallization. Preferably, the reducing atmosphere contains hydrogen gas. The temperature at which the annealing process is carried out is chosen so that the material used does not lose the favorable properties obtained through the high-speed deformation impact process. In the case of molybdenum the maximum temperature is 1100° C.; in the case of TZM the maximum temperature is 1650° C.

The layer which is deposited by means of thermal spraying may consist of molybdenum or any of the known high-melting molybdenum alloys which are suitable for X-ray tube rotary anodes. Examples of suitable materials are: pure molybdenum, TZM alloy (mainly Mo containing 0.40 to 0.55% by weight of Ti and 0.06 to 0.12% by weight of Zr) TZC alloy (mainly Mo containing 1.25% by weight of Ti, 0.15 to 0.25% by weight of Zr and 0.15 to 0.30% by weight of C), an alloy containing 5% by weight of W, remainder Mo, and Mo containing 0.25 to 1.50% by weight of $Y_2O_3$. The abovementioned materials are suitable for use in the disc-shaped portion which is used in the high-speed deformation impact process.

Tungsten and tungsten alloys can be used in the disc-shaped portion which is the intended target area for the electrons. Suitable results have been obtained using alloys of W containing 0 to 10% by weight of Re and using alloys of W containing 0 to 10% by weight of Re and 0 to 4% by weight of Ta. It is also possible to provide one or more disc-shaped portions e.g. of pure tungsten, in between the aforesaid disc-shaped portions, as described e.g. in British Patent Application GB No. 1.437.506 (corresponding to U.S. Pat. No. 4,224,273).

BRIEF DESCRIPTION OF THE DRAWING

An example of the method in accordance with the invention will now be described in detail with reference to a drawing, in which.

DESCRIPTION OF THE PREFERRED EMBODIMENT

Figure 1:
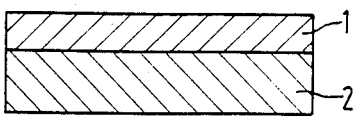
FIG. 1 is a sectional view of two disc-shaped portions prior to the high-speed deformation impact process.

FIG. 1 shows a disc-shaped portion 1 of tungsten or a tungsten alloy and a disc-shaped portion 2 of molybdenum or a molybdenum alloy.

Figure 2:
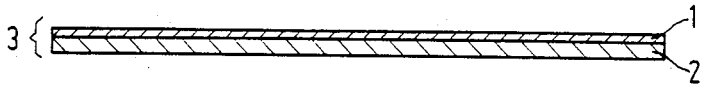
FIG. 2 is a sectional view of the body formed by the high-speed deformation impact process.

FIG. 2 shows a body 3 formed by the high-speed deformation impact process causing the diameter of the disc-shaped portions 1 and 2 to increase and their thickness to decrease. The disc-shaped portions 1 and 2 are joined by the high-speed deformation impact process.

Figure 3:
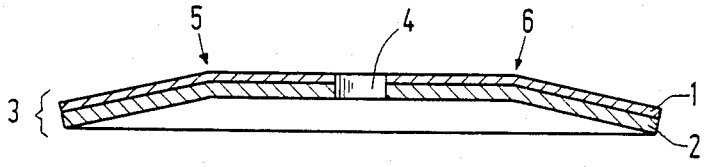
FIG. 3 is a sectional view of the same body after it has been worked into the desired shape and after a center hole has been provided.

FIG. 3 shows the body 3 after it has been provided with a hole for accommodating a shaft (not shown in the drawing). The proper shape has been imparted to body 3 by carrying out mechanical operations and, if necessary, by folding near the points 5 and 6.

Figure 4:
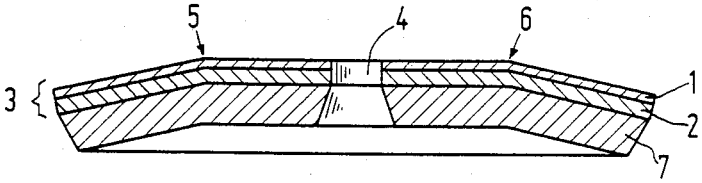
FIG. 4 is a sectional view of a laminated X-ray tube rotary anode in accordance with the invention after application of a layer of molybdenum by thermal spraying.

FIG. 4 shows a laminated anode disc in which a layer 7 which consists of molybdenum or a molybdenum alloy has been applied to the body 3, formed by the disc-shaped portions 1 and 2, by means of thermal spraying. The layer 7 is applied to the disc-shaped portion 2 which also consists mainly of molybdenum. Other layers may also be present between the target layer 1 and the support which is formed by the layers 2 and 7, for example a layer of pure tungsten.

EXAMPLE OF THE METHOD IN ACCORDANCE WITH THE INVENTION

An X-ray rotary anode is manufactured as follows. A cylinder 2 of a cast or sintered molybdenum alloy, for example TZM, whose circumference and length are chosen so that a disc of the required thickness and diameter can be obtained with a deformation degree of at least 60% by means of one high-energy blow, is placed on a cylinder 1 which consists of a W alloy containing 4.5% by weight of Re and which must satisfy the same requirement. Suitable dimensions are, for example, a diameter of 60 mm for both cylinders and a combined thickness of 32 mm.

The discs are preheated to a temperature of 1600° C., after which they are placed between the blocks of a press and subjected to a high-speed deformation impact process. In this process a body 3 is produced having a diameter of 120 mm and a thickness of 8 mm. Instead of using two separate cylinders 1 and 2 in the high-speed deformation impact forming process, it is also possible to use one cylinder consisting of a disc on which there is provided a sintered layer.

The body 3 is folded near the points 5 and 6 and provided with a center hole 4. The surface of the body 3 is suitably cleaned by means of known degreasing techniques, after which it is arranged in a special chamber which can be hermetically sealed. The chamber is evacuated, purged and filled with Ar containing less than 20 ppm of $O_2$.

It is also possible to use He or $N_2$. All the gasses can be mixed with each other and/or with $H_2$ (0 to 25% by volume), prior to usage. Preferably, the evacuation, purging and filling cycle is repeated several times in order to remove any residual oxygen from the chamber. Finally, the chamber is filled with one of the aforesaid gases or gas mixtures to a pressure of one atmosphere. However, it is also possible to apply and maintain reduced pressure during the spraying operation.

Subsequently, the material (in this embodiment Mo containing 5% by weight of W) for the layer 7 is sprayed onto the body 3 by means of a plasma torch, the energy applied to the plasma torch being approximately 32 kW.

Preferably, the basic body 3 is rotated and preheated by means of the plasma torch at a temperature of 1300° C. for 180 seconds, prior to deposition of the material. The material is in powder form, the particle size varying from 5 to 45 μm. A high temperature during the plasma spraying operation will result in a proper bonding of the layer 7 to the body 3; however, too high a temperature will adversely affect the specific properties of the highly deformed discs 1 and 2.

The layer 7 has a thickness of, for example, 13 mm. Upon completion of the plasma spraying operation, the laminated anode disc is annealed in a hydrogen atmosphere at a temperature of 1600° C. for 3 hours. Finally, the product thus obtained is cooled and subsequently subjected to further machining operations during which the annular focal path which is exposed to electrons when used in an X-ray tube, is polished and the desired shape is imparted to the disc, if necessary.

The method according to the invention of manufacturing X-ray tube rotary anodes offers a high degree of freedom as regards their shape especially with rotary anodes having a diameter which exceeds 100 mm. The method according to the invention can also be used for manufacturing smaller rotary anodes having a large thickness-diameter ratio, for example rotary anodes having a diameter of 70 mm and a thickness of 40 mm. The rotary anodes manufactured by means of the method according to the invention exhibit favourable properties for use in an X-ray tube, such as a high mechanical strength, a large heat content, a low emission of gas and a high dimensional stability. In addition, the target layer exhibits only a low degree of roughening during use, which means that the X-ray tube will have a long service life.

What is claimed is:

1. A method of manufacturing a laminated anode for an X-ray tube, said method comprising the steps of:

(a) bonding a target layer consisting essentially of tungsten to a support layer consisting essentially of molybdenum by using a high-speed deformation impact process; and (b) increasing the thickness of the support layer to a thickness sufficient to provide a heat sink for high load operation, by using a thermal spraying process to deposit thereon a material consisting essentially of molybdenum, said thermal spraying process being performed at a temperature which is sufficiently low to prevent the temperature of the anode from exceeding 1650° C., but which is sufficiently high to ensure that the deposited material forms a strong bond and has a density which is at least 85% of the theoretical maximum.

2. A method as claimed in claim 1, characterized in that the thermal spraying process is carried out at a temperature of from 800° to 1600° C.

3. A method as claimed in claim 1 or 2, characterized in that the thermal spraying process is carried out in an atmosphere containing less than 1% by volume of $O_2$.

4. A method as claimed in claim 1 or 2, characterized in that the deposited material has a thickness of at least 6 mm.

5. A method as claimed in claim 1 or 2, characterized in that the thermal spraying operation is carried out by means of plasma spraying.

6. A method as claimed in claim 1 or 2, characterized in that upon completion of the thermal spraying process the laminated anode is annealed in a reducing atmosphere at a temperature of from 1100° to 1650° C. for at least one hour.

7. A method as claimed in claim 6, characterized in that the reducing atmosphere contains hydrogen gas.

8. A laminated anode for an X-ray tube comprising a target layer consisting essentially of tungsten bonded to a support layer consisting essentially of molybdenum by a high-speed deformation impact process, said support layer including thereon a thermally sprayed deposition of a material consisting essentially of molybdenum which increases the thickness of the support layer to a thickness sufficient to provide a heat sink for high load operation, said deposition being thermally sprayed at a temperature which is sufficiently low to prevent the temperature of the anode from exceeding 1650° C., but which is sufficiently high to ensure that the deposited material forms a strong bond and has a density which is at least 85° of the theoretical maximum, the finished anode having a diameter exceeding 100 mm and having a minimum thickness of 12 mm.

* * * * *